US005162647A

United States Patent [19]

Field, Jr.

[11] Patent Number: 5,162,647

[45] Date of Patent: Nov. 10, 1992

[54] COLOR IMAGE INTENSIFIER DEVICE UTILIZING COLOR INPUT AND OUTPUT FILTERS BEING OFFSET BY A SLIGHT PHASE LAG

[75] Inventor: Robert J. Field, Jr., Fincastle, Va.

[73] Assignee: ITT Corporation, New York, N.Y.

[21] Appl. No.: 662,268

[22] Filed: Feb. 28, 1991

[51] Int. Cl.[5] ..... H01J 40/14

[52] U.S. Cl. ..... 250/214 VT; 358/42

[58] Field of Search ..... 250/213 VT, 213 R, 524; 358/42, 60, 210

[56] References Cited

U.S. PATENT DOCUMENTS

| | | | |
|---|---|---|---|
| 2,724,737 | 11/1955 | Hogan | 358/60 |
| 3,231,746 | 1/1966 | Goorich | 250/213 VT |
| 3,812,526 | 5/1974 | Tan | 358/42 |
| 3,863,093 | 1/1975 | Orthuber | 250/213 VT |
| 4,374,325 | 2/1983 | Howorth | 250/213 VT |

*Primary Examiner*—David C. Nelms
*Assistant Examiner*—Que T. Le
*Attorney, Agent, or Firm*—Arthur L. Plevy

[57] ABSTRACT

A color image intensifier device combines an image intensifier tube providing monochrome output with input and output color members each having a plurality of color portions for passing respective different light frequencies. The input color member filters the incoming light to the tube for each light spectrum band in timed succession, and the monochrome output of the tube passes through the output color menber to produce a corresponding color component output. The color component outputs are perceived by the eye as a complete color image if the timed modulation of the incoming image is above the threshold level for flicker. In a mechanical version, the color members are input and output color wheels rotated in tandem at the input and output ends of the image intensifier tube. The filter members may also be arranged in the form of linearly reciprocating slides or planes movable in two dimensions. The color members can also be stationary filters which change color by electronic control. The color members may have different input and output filter portions for assigning a false color to a selected input light band, such as infrared light.

15 Claims, 3 Drawing Sheets

COLOR IMAGE INTENSIFIER DEVICE UTILIZING COLOR INPUT AND OUTPUT FILTERS BEING OFFSET BY A SLIGHT PHASE LAG

FIELD OF INVENTION

The present invention relates to an image intensifier device, and particularly, to one having means for converting an input light image to an output color image.

BACKGROUND OF INVENTION

Currently available image intensifier devices convert low level images of visible and near infrared light into visible monochrome images. The image intensifier device typically converts incident light into an amplified level image by using a photocathode to generate an amplified electron flow corresponding to the image areas where light is received, and a luminescent screen to generate an output light image from the electron flow. The luminescent screen generally contains a phosphor material which radiates monochrome light when struck by electrons.

However, image pattern recognition can often be easier with a color image rather than a monochrome image. Also, a color image is more desirable in certain applications, such as when it is desired to use an image intensifier device as a front end of a low-light-level color video or still camera, for low ambient light surveillance, or for some consumer applications. A color image intensifier device could also prevent image loss under certain critical conditions, such as in dust, haze or glare, by providing an output image in separate or false colors corresponding to the less glareful or non-obscured light frequencies.

SUMMARY OF INVENTION

It is therefore a principal object of the invention to provide an image intensifier device capable of providing an output color image. It is a further object to provide such a device capable of providing an output image in colors selected for designated light frequencies, such as infrared light or light frequencies not obstructed by dust, haze, or glare.

In accordance with the invention, a color image intensifier device comprises: an image intensifier tube for amplifying an input light image received at an input end to an output light image at an output end thereof; a pair of color members each having a respective plurality of color portions for passing respective different light frequencies, wherein one color member is arranged at the input end of said image intensifier tube and the other color member is arranged at the output end of said image intensifier tube; and actuating means for actuating corresponding color portions of the color members in timed succession for each of the plurality of different light frequencies in tandem with each other, such that each input color portion passes a respective input light frequency of the input light image which is amplified by said intensifier tube, and each output color portion in tandem with the corresponding input color portion receives the output light image from said image intensifier tube and passes a respective output light frequency.

In one preferred embodiment, the color members are input and output color wheels having corresponding primary color filter portions thereon which are rotated in tandem at the input and output ends of the image intensifier tube. The color wheels can be rotated synchronously, or with the output color wheel at a slight phase lag from the input color wheel to compensate for a slight time delay of propagation of the light image through the image intensifier tube. In alternate embodiments, the filter members may be arranged in the form of linearly reciprocating slides, or planes movable in two dimensions. In a further embodiment, the color members can be stationary input filters which change color by electronic control, and/or stationary output filters or phosphor elements. The color members may have different input and output filter portions for assigning a false color to a selected input light band, such as infrared light.

BRIEF DESCRIPTION OF DRAWINGS

The above objects and further features and advantages of the invention are described in detail below in conjunction with the drawings, of which.

DETAILED DESCRIPTION OF PREFERRED EMBODIMENTS

Figure 1:
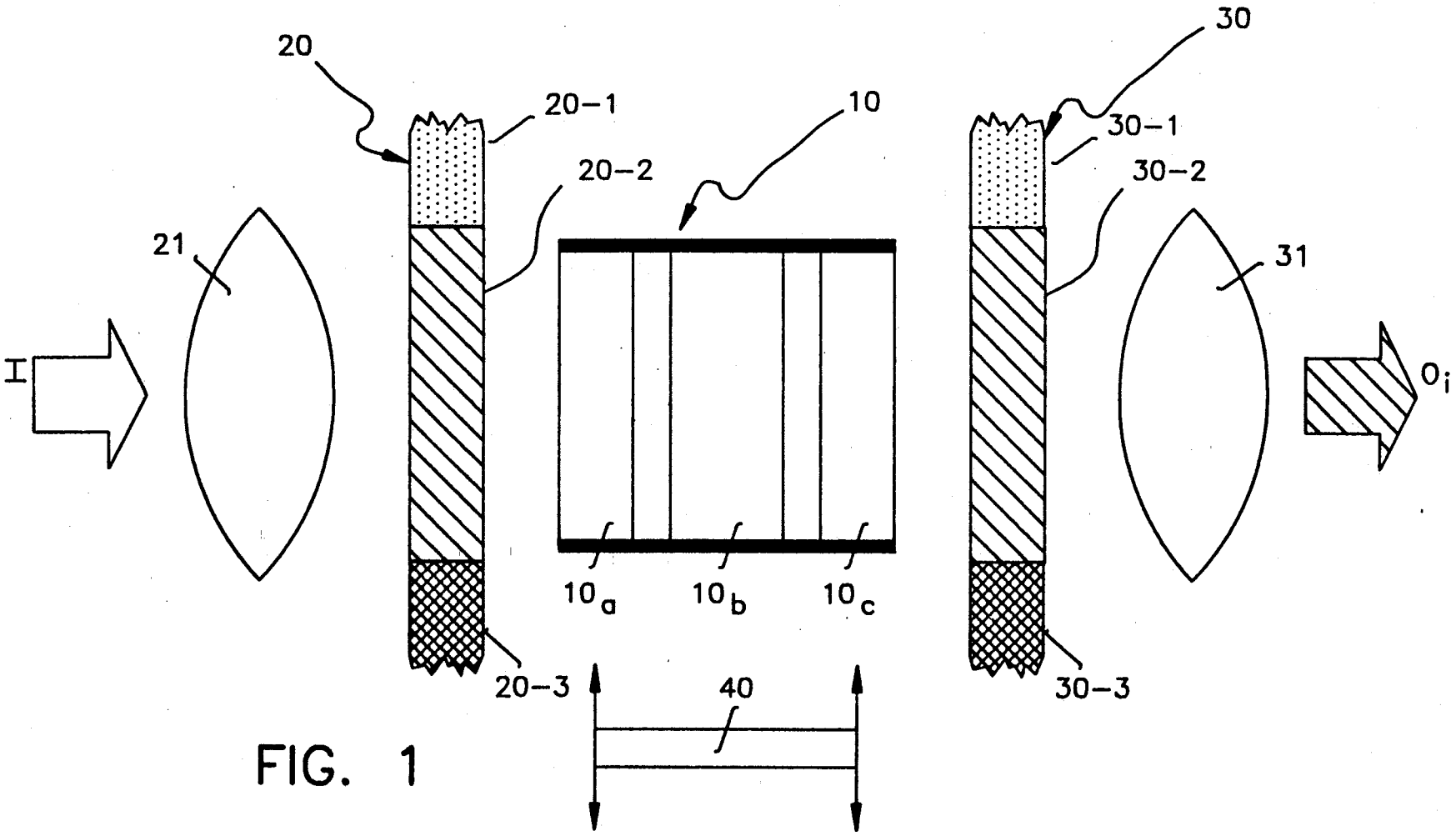
FIG. 1 is a schematic view of an image intensifier tube provided with input and output filter members actuated in timed succession to produce an output color image in accordance with the invention.

Referring to FIG. 1, the color image intensifier device in accordance with the invention has an image intensifier tube 10 for amplifying an input light image I received at an input end to an output light image from an output end thereof. The image intensifier tube generally includes an input faceplate and/or collimator section 10*a*, a photocathode section 10*b* for generating an electron flow in response to impingement of incident light, and a luminescent screen 10*c* for generating an output light image corresponding to the intensity of the electron flow. A pair of filter members 20 and 30 each have plurality of color portions 20-1, 20-2, 20-3, . . . and 30-1, 30-2, 30-3, . . . corresponding to each other. Input and/or output lenses 21, 31 may be provided to obtain optimal optical characteristics for the system.

The color members are shown, for purposes of illustration only, with moving filter portions for passing respective different light frequencies, for example, the primary colors red, blue, and green. The filter members 20, 30 are moved mechanically in tandem by an actuating or driving mechanism 40, so that each pair of corresponding filter portions is brought before the input and output ends of the image intensifier tube in timed succession. Thus, the input image I is filtered to pass each of a selected plurality of light frequency bands in sequence. In the figure, one filter portion 20-2 is shown positioned in front of the image intensifier tube 10 to pass light of the corresponding frequency band for the input image, which is then amplified by the image intensifier tube 10. The tube 10 typically has an output phosphor screen 10*c* which generates monochrome output light. The corresponding output filter portion 30-2 filters the monochrome output light to pass a selected output light frequency band of the image $O_i$. The corresponding filter portions of the filter members are cross-hatched similarly. However, it is not necessary that they be the same color. For example, an output false color may be assigned for a selected input light frequency, as described further herein.

In broad concept, the color image intensifier device of the invention time-modulates the input light image to produce a rapid series of color image components that are perceived by the eye, at a sufficiently high sampling rate, as a complete color image. The conventional image intensifier tube having a white phosphor output can thus be used to produce a color image. The successive illuminations through the plurality of filter portions are operated fast enough compared to the image retention time of the eye so that the eye does not perceive a flicker. The movements of the pair of filter members are synchronized mechanically so that they can be operated by the same motor drive. At any moment, for any point on the input plane, each filter portion passes only a selected fraction or frequency band of the input light spectrum. Each succeeding filter portion passes a respective different fraction of the input light spectrum, and a correspondingly filtered output is produced with an intensity proportional to the input. By moving at least three primary filter colors across an image within a short time, a full color image can be produced by the superposition of the at least three color image components. The timed movement of each output filter portion may be slightly delayed in time with respect to the corresponding input filter portion, if necessary, to compensate for any propagation delay through the tube.

Figure 2A:
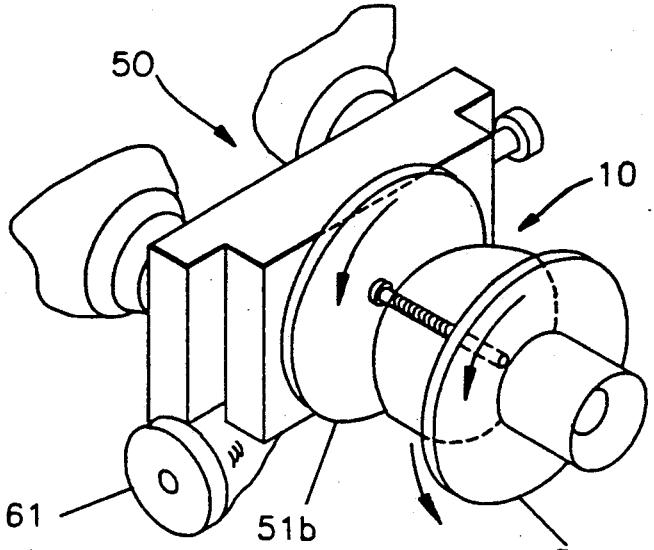
FIGS. 2A and 2B show a rotary wheel implementation of the input and output filter members for a targeting scope or similar device.
Figure 2B:
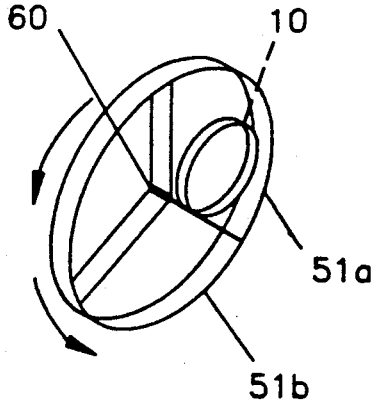

As shown in FIGS. 2A and 2B, one preferred implementation of the color image intensifier for a targeting scope or similar device 50 employs a simple filter moving scheme, i.e., two three-color filter wheels 51*a* and 51*b* mounted on a common drive shaft 60 which is coupled to a motor drive 61 for the device 50. Each filter wheel is divided into three filter sectors for filtering respective primary color components, e.g., red, blue, and green. The two filter wheels are rotated in tandem at the input and output ends of the image intensifier tube 10. The output filter wheel 51*b* is shown slightly lagging the input filter wheel 51*a* in phase to account for propagation delay through the image intensifier tube 10. The color filter wheels are driven at a speed of approximately 1800–3000 rpm which is above the threshold at which flicker would be perceived. The spinning shaft and color filters can have a stabilizing function for stabilized binocular applications due to their gyroscopic effect.

Figure 3A:
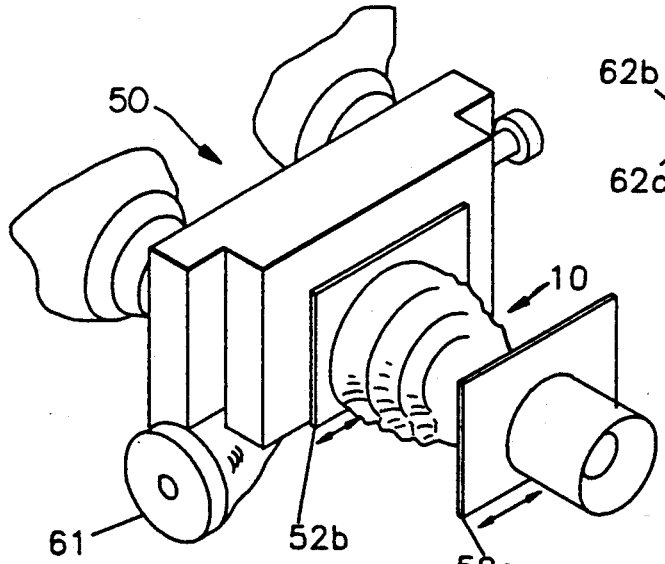
FIGS. 3A and 3B show a reciprocating linear slide implementation of the input and output filter members for the targeting scope.
Figure 3B:
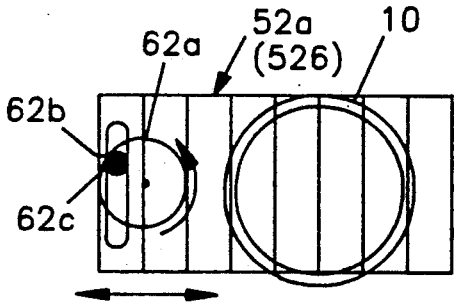
Figure 4:
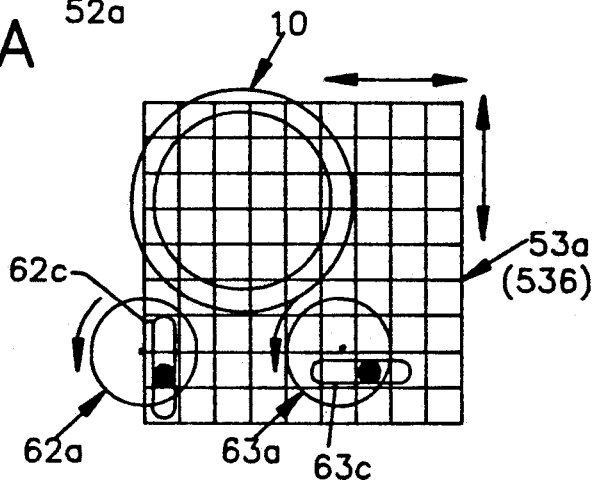
FIG. 4 shows a two-dimensional plane implementation of the input and output filter members.

In the above embodiment, the filter wheels 51*a* and 51*b*would need to be more than twice the diameter of the image intensifier tube 10, resulting in a rather bulky system compared to the size of the tube. Therefore, an alternate embodiment shown in FIGS. 3A and 3B employs a pair of linearly reciprocating slides 52*a* and 52*b* which are driven back and forth along respective guideways in front and in back of the tube 10. Each filter slide is divided into a corresponding series of color filter segments made of color transparency film. The segments are moved across the aperture of the image intensifier tube 10 to generate corresponding color components outputs which are perceived by the eye as a complete color image. The spectrum period of the slides are the same as or less than the reciprocation distance. The drive mechanism for the slides can be in the form of a cam 62*a* having drive pins 62*b* at an eccentric radial position which are engaged in slots 62*c* in each slide to drive the slides laterally in reciprocating directions as the cam 62*a* is driven in rotation by the motor 61. In another scheme shown in FIG. 4, the filter portions are color filter blocks arrayed on two-dimensional planes 53*a* and 53*b*. The planes are driven in two dimensions by respective X and Y-axis drive cams 62*a*, 63*a* and drive slots 62*c*, 63*c*.

Figure 5A:
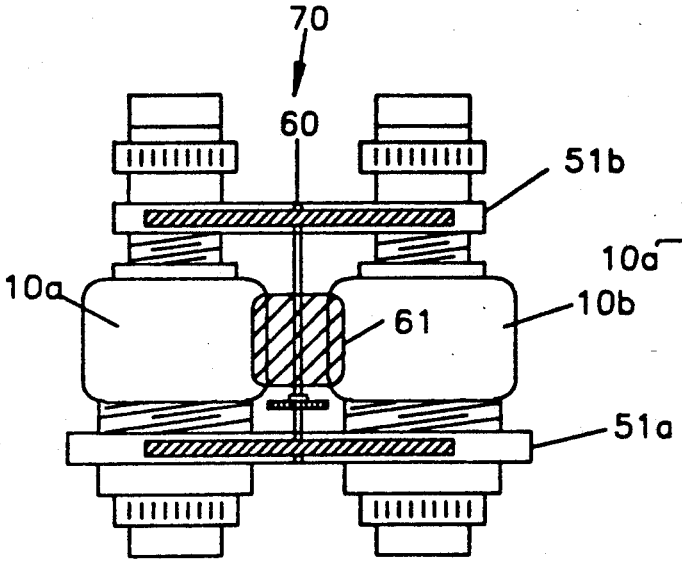
FIGS. 5A and 5B show a rotary wheel implementation of the input and output filter members for a pair of binoculars having a pair of image intensifier tubes.
Figure 5B:
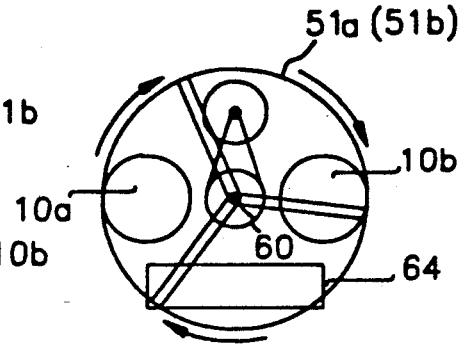
Figure 6A:
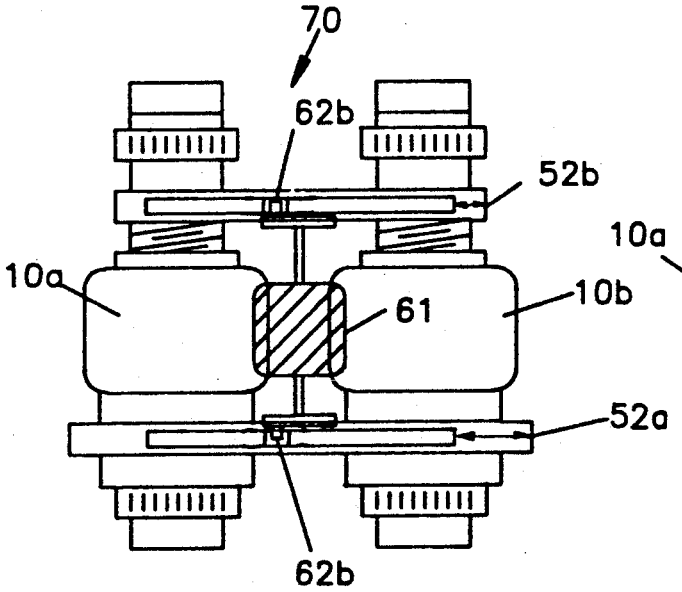
FIGS. 6A and 6B show a reciprocating linear slide implementation of the input and output filter members for the binoculars.
Figure 6B:
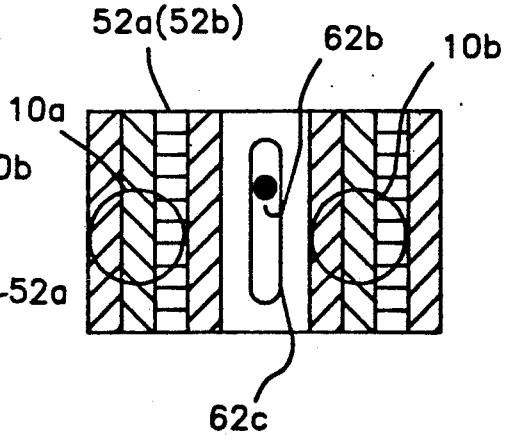

In FIGS. 5A and 5B, the rotary filter wheels 51*a* and 51*b* are shown applied to a pair of binoculars 70 having a pair of image intensifier tubes 10*a*, 10*b*. The filter wheels are mounted to and rotated by the common shaft 60 which is driven by the motor 61. The position of batteries 64 is also shown for a compact drive configuration. In FIGS. 6A and 6B, the linear filter slides 52*a* and 52*b* are applied to the binoculars 70 to be driven across the pair of image intensifier tubes 10*a*, 10*b* by the cam pins 62*b* in respective slots 62*c* as driven by the motor 61.

The moving filter boundaries are expected to produce some mixing of colors as they pass over a position on the image plane. For example, if the filter colors are red, blue, and green, and the device is transmitting the image of a blue region on the image plane, then as the moving blue filter is replaced by the moving green filter, the light to the image intensifier tube becomes cut off. However, the cutoff is not sharply defined on the input focal plane since the filter is out of focus. Hence the input light level drops to 50% when the filter boundary is directly over a position on the input focal plane. Correspondingly, the image intensifier output is 50% of its original level and dropping to zero as the blue/green filter boundary passes by. Some of this transition level light is then output through the green output filter, causing a loss of color saturation and mixing of color. The magnitude of this effect would depend on the size of the defocused point on the image plane relative to the filter size. Similar effects can occur if the decay time of the phosphor screen of the image intensifier tube is too long, such that the phosphor which lights up in correspondence to one filter color is still decaying when light from the next color filter is being transmitted. A typical time constant requirement for white phosphor is of the order of 1 millisecond.

These effects can be minimized by using black borders at the filter boundaries. The black borders will cause the phosphor screen output to be blocked off during transitions between colors. Incoming light at the input image plane is prevented from passing through an adjacent filter element. The width of the black borders is selected to be about the same size as the expected sizes of the unfocused image points for the type of use the overall device is designed for.

Stationary filters avoid the problems of moving parts. As a further embodiment, the invention may be implemented such that the color members are not moved mechanically, but rather are in stationary positions at one or both ends of the tube. Stationary color members may be, for example, liquid crystal filters which would change colors in response to external control signals, or semiconductor absorption filters (such as AlGaAs) which transmit different light frequencies in response to applied control signals. The control signals would be timed electronically to obtain the same effect as the mechanically driven filters. However, the stationary filters may not be able to change colors instantaneously, thereby also resulting in some loss of color saturation. This may be avoided by interrupting the image intensifier operation while the filter color is changing.

The color members can be implemented using a hybrid of input and output filter types for optimal size and performance characteristics.

The invention may also be applied to generate a false color image for certain frequencies of light, for example, infrared light. False color imaging can be used for generating infrared images or for adding an infrared contribution to an overall color image. This is obtained by using different types of filter elements for the input and output. For example, incoming infrared light can be passed by an input infrared filter, and the light output generated by the image intensifier tube can be filtered by an orange output filter as an orange color component. The resulting color image would be an orange-colored image or would have an orange glow on regions where infrared light is emanated. The false color mapping of input and output color components may be adjusted for optimal use in different field conditions. For example, the output color mapping may be selected for optimal contrast, to emphasize the presence of light of certain frequencies, e.g., infrared, or for aesthetic results. The false color scheme may even be used for photographs in still cameras. Conversely, an output infrared filter may be used for infrared photographic film.

Color filters can be mass produced using color transparency film. The resulting filters would be lightweight, which is important for reducing vibrations in the reciprocating filter scheme. Continuous spectrum filters can also be produced using photographic filter production methods. The input filter may also be an interference type filter.

The invention thus converts an image intensifier tube with a monochrome output to color image use by the time-modulated filtering of incoming light and the resulting output light. The filtering time modulation can be accomplished by simple mechanical synchronization of input and output filter movements, or electronic synchronization of stationary filter elements. Different mechanical arrangements are provided, with the linear reciprocating slide filters providing the most compact arrangement. Black borders are used between filter colors of moving filter members to reduce color saturation loss due to the filter boundaries. The false color mapping scheme allows special aesthetic, contrast, or imaging effects to be obtained. The color image intensifier device can be applied to a wide range of products, such as color targeting scopes, binoculars, night vision goggles, still or video cameras, false color viewfinders and imaging devices, medical instruments, etc.

The specific embodiments of the invention described herein are intended to be illustrative only, and many other variations and modifications may be made thereto in accordance with the principles of the invention. All such embodiments and variations and modifications thereof are considered to be within the scope of the invention, as defined in the following claims.

I claim:

1. A color image intensifier device comprising:

an image intensifier tube for amplifying an input light image received at an input end to an output light image at an output end thereof;

a pair of color members each having a respective plurality of color portions for passing respective different light frequencies, wherein one color member is arranged at the input end of said image intensifier tube and the other color member is arranged at the output end of said image intensifier tube; and actuating means for actuating corresponding color portions of the color members in timed succession for each of the plurality of different light frequencies in tandem with each other, such that each input color portion passes a respective input light frequency of the input image which is amplified by said intensifier tube, and each output color portion in tandem with the corresponding input color portion receives the output light image from said image intensifier tube and passes a respective output light frequency, said output color member being offset by a slight phase lag from the input color member to compensate for a slight time delay of propagation of the light image through the image intensifier tube.

2. A color image intensifier device according to claim 1, wherein said input and output color members are input and output color wheels having corresponding primary color filter portions thereon which are rotated in tandem at the input and output ends of the image intensifier tube.

3. A color image intensifier device according to claim 2, wherein said actuating means includes drive means for rotating said color wheels synchronously.

4. A color image intensifier device according to claim 1, wherein said input and output color members are input and output color slides having corresponding primary color filter portions thereon which are linearly reciprocated in tandem at the input and output ends of the image intensifier tube.

5. A color image intensifier device according to claim 4, wherein said actuating means includes drive means for rotating a cam having an eccentric element for reciprocating said color slides in tandem.

6. A color image intensifier device according to claim 1, wherein said input and output color members are input and output color planes having corresponding primary color filter portions thereon which are moved in tandem in X and Y dimensions at the input and output ends of the image intensifier tube.

7. A color image intensifier device according to claim 1, wherein said output color member has an output color portion of a different color component than the corresponding input color portion of the input color member for assigning a selected or false color to a selected input light frequency.

8. A color image intensifier device according to claim 7, wherein said input color portion is selected to pass an infrared light frequency, and said output color portion is selected to pass a visible color light frequency.

9. A color image intensifier device according to claim 1, wherein said image intensifier tube has a white phosphor screen at its output end.

10. A color image intensifier device according to claim 1, wherein said input color member is stationary and the color portions thereof are actuated by electronic control in timed succession.

11. A color image intensifier device according to claim 10, wherein said input color member is a liquid crystal device capable of changing color under electronic control.

12. A color image intensifier device according to claim 10, wherein said input color member is a semiconductor absorption filter capable of passing light of different frequencies under electronic control.

13. A color image intensifier device according to claim 1 , wherein said device is applied as an input component of a targeting scope.

14. A color image intensifier device according to claim wherein a pair of said devices are applied as paired input components of a pair of binoculars.

15. A color image intensifier device according to claim 1, wherein said input and output color members are input and output color filters having corresponding primary color filter portions thereon, and wherein black borders are provided between adjacent color filter portions to minimize color saturation loss caused by the moving filter boundaries.

* * * * *